US005242348A

United States Patent [19]

Bates

[11] Patent Number: 5,242,348

[45] Date of Patent: Sep. 7, 1993

[54] MULTIFUNCTIONAL EXERCISE DEVICE

[76] Inventor: Patricia A. Bates, 240 S. Reeves Dr. #1, Beverly Hills, Calif. 90212

[21] Appl. No.: 867,478

[22] Filed: Apr. 13, 1992

[51] Int. Cl.[5] ..... A63B 21/065

[52] U.S. Cl. ..... 482/105; 482/93; 482/113

[58] Field of Search ..... 482/93, 105, 108, 148, 482/113, 121, 122; 273/58 F, 65 EC, DIG. 20

[56] References Cited

U.S. PATENT DOCUMENTS

| | | | |
|---|---|---|---|
| 3,808,824 | 5/1974 | Johnston et al. | 482/105 |
| 4,218,057 | 8/1980 | Wilson | 482/93 |
| 4,278,248 | 7/1981 | Kifferstein | 482/93 |
| 4,382,302 | 5/1983 | Watson | 482/105 |
| 4,846,464 | 7/1989 | Jorno | 482/108 |
| 4,923,418 | 5/1990 | Hoffman | 482/105 |
| 4,988,093 | 1/1991 | Forrest, Sr. et al. | 482/105 |

FOREIGN PATENT DOCUMENTS

| | | | |
|---|---|---|---|
| 0642266 | 4/1984 | Switzerland | 482/93 |

*Primary Examiner*—Richard J. Apley
*Assistant Examiner*—Lynne A. Reichard
*Attorney, Agent, or Firm*—Breneman & Georges

[57] ABSTRACT

A multifunctional exercise device is provided for use in muscle toning exercises for low impact aerobic workouts to increase the general body tone, strength and endurance. The multifunctional exercise device includes a resilient elastomeric body having a cylindrical hollow core designed to accept multifunctional and nestable hand weights for disposition in position in the cylindrical core of the resilient elastomeric body. The elastomeric body is covered with a cover of cloth or other suitable material having an opening at one end for accessing the removable weights and a multifunctional elastic strap for encircling the circumference of the multifunctional exercise device and for assisting in maintaining the detachable weights in position in the cylindrical core of the multifunctional exercise device. The novel multifunctional exercise device allows a wide variety of exercise regimens including isotonic and isokinetic exercises with both concentric and eccentric forces to be accomplished for a wide variety of muscle tone programs suitable for all age and strength groups to increase stamina, body tone and strength without the muscle damage that may occur with high impact and stress exercises.

20 Claims, 8 Drawing Sheets

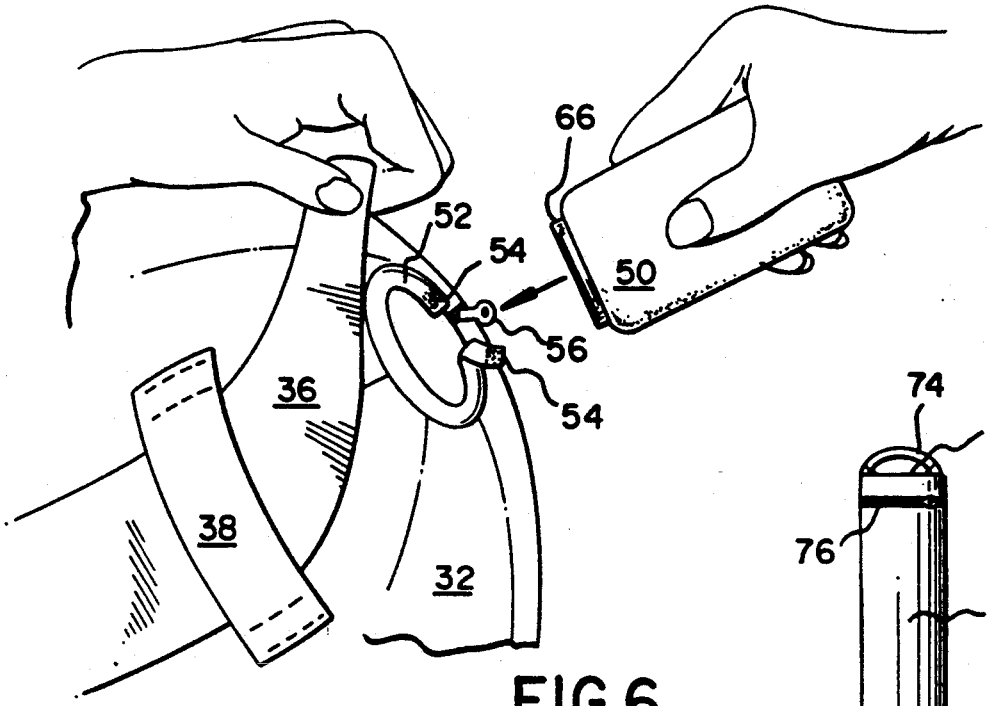
FIG.6
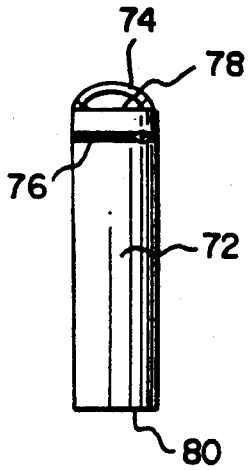
FIG. 5
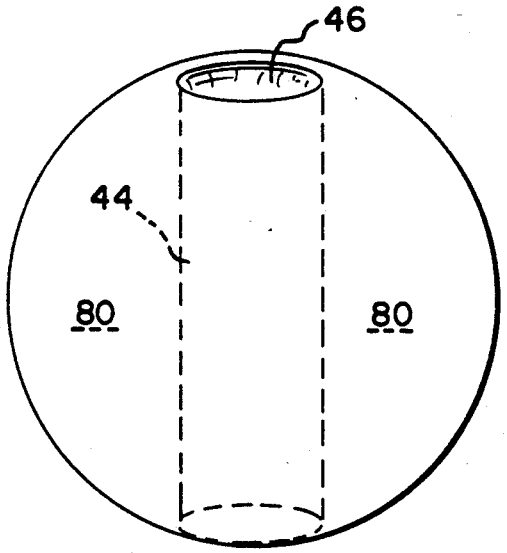
FIG. 7
FIG. 8
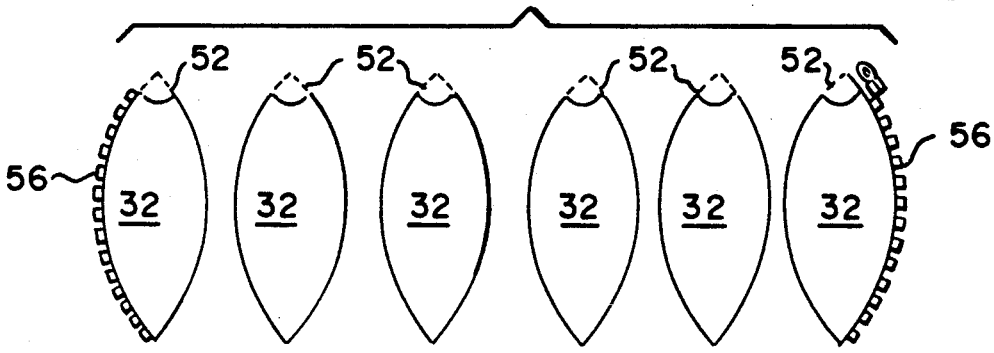

MULTIFUNCTIONAL EXERCISE DEVICE

BACKGROUND OF THE INVENTION

Field of the Invention

The invention pertains to a multifunction exercise device which allows a wide variety of exercise regimens and programs to be accomplished by utilizing a low impact aerobic exercise device for toning the body and increasing strength and endurance without harmful impact and stress exercises which damage, tear or pull muscles. More particularly the invention pertains to a lightweight resilient substantially elastomeric spherical ball having a substantially hollow center passage for accepting and maintaining in position one or more multifunctional weights in the center passage of the ball. The multifunctional strap serves not only to close the passage but also to maintain the weights in the core opening of the multifunctional exercise ball while at the same time providing an elastic self stowing handle for not only gripping the multifunctional exercise ball but also providing for a variety of exercises resulting from the combination of pulling, pressing and squeezing the multifunctional elastic strap together with the multifunctional exercise ball.

The novel multifunctional exercise ball and separate multifunctional core weights constructed in accordance with the invention are particularly applicable to low impact aerobic workouts based on repetitions of pulling, squeezing and pushing to increase general body tone, strength and endurance without damaging muscles. The multifunctional exercise ball in accordance with the invention allows a great deal of flexibility not only in the exercise programs but also in the selection of the various elements utilized in the construction of the multifunctional exercise ball. As a result of this flexibility the exercise ball may be utilized with in one embodiment for aged people and young people and in another embodiment utilized the same combination of elements but with a modification of the materials of those elements resulting in an exercise device that can be utilized for young and strong individuals to further increase strength, muscle tone and endurance.

The invention in its preferred mode includes a substantially spherical body of a resilient elastomeric material which in one embodiment may be foam for use by young people or aged people or be substantially hollow in the form of a bladder to be filled with a fluid such as air or a liquid for use by strong individuals for increasing their muscle tone. Similarly the center core passage may contain multifunctional hand weights having straps that may be as low as a half pound to five pounds or be five to twenty pounds or more for stronger individuals.

The multifunctional elastic strap which covers the cylindrical core passage of the substantially spherical multifunctional exercise ball may be made of cloth or made of a heavy duty elastic or rubber material for applications involving stronger individuals for more vigorous exercise workout programs. As such the invention allows a wide degree of flexibility in materials and components to be utilized to provide a wide variety of exercise regimens for low impact aerobic muscle toning workouts for application to young, old, strong and weak persons having a wide range of conditions of muscle tone, strength and endurance.

Description of the Prior Art

The prior art includes a wide variety of exercise devices including throwable and catchable tackling bags, collapsible dumbbells, aerobatic water weights and various shapes and forms of exercise balls. These prior art devices have included various types of center core materials, coverings and fillers to give the exercise device shape and form. Some of the more relevant prior art exercise balls have also included openings for including weights to add mass to the exercise ball.

One pertinent example as represented by Minor U.S. Pat. No. 777,478 pertains to an exercise ball having a door provided in the outer covering for receiving weights that are held in place by a series of graduated recesses which include spring depressed pins for holding the weights in place. Minor U.S. Pat. No. 777,478 in addition includes a band for supporting handles for the purpose of carrying the exercise ball.

Unlike the invention Minor U.S. Pat. No. 777,478 is not a multifunctional exercise ball in that it does not include separate multifunctional hand weights which are removable and hand held in exercise routines nor does it include an elastic band for closing the weight door openings. Further unlike the invention Minor U.S. Pat. No. 777,478 does not include self stowable handles that are multifunctional and are designed to cooperate with the body of the ball to provide variable resistances in conjunction with the resilient elastomeric interior of the ball to vary resistances and provide for a number of varying exercise routines.

The prior art also includes weighted warmup balls having a metal center core with a small amount of silicone, rubber or similar material surrounding the metal center core for adhesively bonding the cord to intermediate material. Such prior art as represented by Corley U.S. Pat. No. 4,943,055 is for the purpose of providing warmup balls similar to soft balls and other balls used in baseball. Such prior art devices are marketly different than the invention in that the metal core of U.S. Pat. No. 4,943,055 is not intended to be removed and used separately in exercise routines nor is a resilient material provided to be compressed in relation to an elastic outer band of a stretch material to provide compression and extension exercise activities.

Additional prior art such as Jenison U.S. Pat. No. 4,695,051 provides a bladder type device which can be filled with liquid to form a dumbbell and thereafter be drained for purpose of storage. The collapsible dumbbells of Jenison do not include provision for separate hand weights which are removable from the center of the dumbbell nor is an elastic band provided around the dumbbell to provide for compression and extension exercises by providing for a variable resistance exercise device.

The prior art also includes various types of throwable and catchable exercise balls and tackling bags such as Cituk U.S. Pat. No. 3,111,317 which similarly provides for weights in a core surrounded by a padding material and outer covering. These weights in such prior art devices are generally for the purpose of adding weight or bulk to the devices or bags and not intended to be readily removed and used as a part of a separate exercise device in aerobic workouts. Such prior art devices also do not include a multifunctional exercise band around the exercise device which multifunctional band serves not only as a handle which collapses against the surface of the ball but also serves as an elastic resistance device for cooperating with the center material of the ball to provide a wide variety of exercise regiments based on compression and variable resistances resulting from the elastic band.

The invention unlike the prior art combines a number of novel features to provide a multifunctional exercise device which utilizes multifunctional weights that serve not only as separate hand weights, leg weights or body weights for parts of the body but which also are designed to nest in a substantially hollow opening in the multifunctional exercise ball. The multifunctional weights are captured in the center passage of the exercise device and are maintained in place by a multifunctional handle or strap which not only covers the opening for the multifunctional weights but also serves to provide an elastic variable resistance in combination with the elastic resilient nature of the body of the exercise device.

These features of the invention coupled with the ability to significantly change the character of the multifunctional exercise ball by substituting a closed cell foam or a bladder for the rubber foam core and substituting a thick rubber band or strap in place of a stretch woven fabric band allows the invention to be adapted to a wide variety of weights and exercise regimens and programs that are not available utilizing devices constructed in accordance with the prior art. The novel arrangement of components of the invention provides considerable versatility in the construction and design of multifunctional exercise devices in accordance with the invention in a variety of geometrical configurations to provide a wide range of low impact aerobic programs for increasing general body tone, strength and endurance.

SUMMARY OF THE INVENTION

The disadvantages and limitations of the prior art are obviated in accordance with the invention by the utilization of a combination of multifunctional weights which may be used alone or together with the multifunctional exercise device together with a multifunctional strap which operates not only as a handle but also as a closure of the opening in the multifunctional device for receiving the multifunctional weights and as a separate variable resistance exercise device. The elastic strap which operates as a separate variable resistance elastic exercise device further cooperates with the multifunctional weights and the body of the multifunctional exercise device to provide variable resistance in pulling and stretching exercises.

The multifunctional weights are of a square, circular or cylindrical configuration. These multifunctional weights are encased in padding or covering and include an optional elastic band connecting the ends of the weight so that they may be utilized for elastic engagement to wrists, hands, ankles and other parts of the body. The multifunctional weights are designed to fit into a substantially cylindrical passage through the center of the generally spherical multifunctional exercise ball.

The body of the generally spherical exercise ball is composed of an elastomeric material whose resistance to squeezing or compression depends upon the level of strength of the person using the multifunctional exercise ball. Typically the body of the resilient elastomeric material is of a foam construction which may be open cell or close cell. An open cell material is preferred when the exercise ball is used for children, the aged or in high repetition, low impact exercise routines. In more advanced exercise programs exercise devices constructed in accordance with the invention may employ a foam material having a closed cell construction which provides substantially greater resistance to compression. In the most advanced format for use in heavy exercise workouts the body of the ball is in the form of a spherical bladder having a hollow cylindrical axis so that the bladder may be filled with air, water or other fluid to provide substantial mass and resistance to compression as well as providing a substantially heavy compressible body.

The resilient body whether it be of open cell, close cell or bladder type construction is designed to be covered with an outer covering which in the preferred application closes one end of the cylindrical opening of the passage or channel extending through the exercise ball. In this manner the multifunctional weights may be added or removed through only one end of the multifunctional ball.

The combination of the resilient elastomeric material of the body of the ball in combination with the size and covering material of the weight is generally sufficient to hold the weights in the cylindrical passage in the multifunctional exercise ball. The outer covering may also include a constrictive closure means such as a drawstring or an elastic biased closure having a velcro, snap or other type closure for constricting the cover around the opening after the multifunctional weights have been placed into or removed from the multifunctional exercise ball.

The multifunctional elastic band serves not only as a self stowable handle but also as a separate variable resistance exercise device which in combination with the resilient nature of the body of the ball operates as a means for accomplishing a wide variety of exercise routines. The multifunctional elastic strap is also designed to close the constricted end of the exercise ball and provide variable resistance for exercising. One or more loops are provided to maintain the multifunctional strap around the circumference of the multifunctional exercise ball. One or more of the loops may be detachable loops to assist in the opening and closing of the passage for removal of the weights and to allow the strap to be repositioned around the circumference of the exercise ball.

As a consequence of its design the multifunctional exercise ball can be used in a variety of low impact aerobic exercises to increase general body tone, strength and endurance. The low impact aerobic nature of the device is designed to prevent overexertion of muscle tissues and prevent tissue tears and the hyperextensions of muscles. As such the novel exercise device is adaptable to all ages, sexes and body strengths by making minor adjustments in the size of the weights and materials used in the construction of multifunctional exercise devices constructed in accordance with the invention.

The novel exercise ball is versatile in providing various kinds of exercise such as isotonic with both concentric and eccentric forces, isokinetic and isometric muscle contractions. Isotonic contraction occurs when the tension changes during the muscle contraction. Isokinetic contraction occurs when the tension on the muscle stays the same as the muscle changes in length. Isometric contraction occurs when no muscle shortening occurs when resistance is applied. The novel multipurpose exercise ball allows the foregoing types of muscle contractions to occur in various exercise routines to provide for a complete body tone and a strengthening program with maximal tension. Since the ball can be constructed in a virtually weightless configuration it can be used safely in low impact or step classes where the benefits of large weights are not desired or are questionable. The multifunctional exercise ball can also be utilized with weights and also be designed in a bladder embodiment to provide additional advantages where high muscle bulk and strength is desired.

In the low impact, high repetitive embodiment of the invention the body of the ball is made of foam rubber and is preferably of an open cell configuration such that it takes five pounds or more pressure on the outside surface of the ball to begin to compress the hollow center core of the ball. In such lightweight arrangements the multifunctional strap is made of a woven rubber or a fabric elastic strap. In such applications the multifunctional weights also weigh from one to five pounds each and are covered with cloth or other padding type material and preferably include an optional elastic strap.

In applications where greater strength and bulk are desired the multipurpose exercise ball may have its body made of a closed cell foam configuration or be of a bladder type configuration which can be filled with fluids such as air or liquids such as water so that once the bladder is filled many tens of pounds of pressure may be required to change the configuration of the center core opening. In such embodiments the weights may also be increased from five pounds or greater and the elastic strap may be replaced with a pure rubber strap so that many pounds of tension or force are required to pull and stretch the multifunctional strap from the surface of the multifunctional exercise ball. In such embodiments where a bladder is used, an optional pump may be utilized to fill or add pressure to the bladder.

In the various embodiments and applications of the invention the novel multifunctional exercise ball includes a substantially spherical, resilient body having an opening extending through the central axis of the sphere together with multifunctional exercise weights for nesting in the cylindrical opening and optionally a cover and finally a multifunctional elastic strap for encircling the circumference of the spherical multifunctional ball. Optional detachable straps or loops for holding the multifunctional band in place may be advantageously utilized together with optional features such as pumps or other means for increasing or decreasing the compressibility of the spherical body of the multipurpose or multifunctional exercise device.

DESCRIPTION OF THE DRAWINGS

Other advantages of the invention will become apparent to those skilled in the art from the following detailed description of the invention in conjunction with the accompanying drawings in which:

FIG. 5 is an elevational view of the weight positioning tube for positioning weights in the substantially hollow core of the novel multifunctional device;

FIG. 6 is a perspective view of the top portion of the novel multifunctional ball;

FIG. 7 is a side elevational view partly in phantom illustrating one embodiment for a resilient spherical body of the novel multifunctional ball;

FIG. 8 is an isogonic projection of a cover for the multifunctional exercise ball;

DETAILED DESCRIPTION OF THE PREFERRED EMBODIMENT

The best mode and preferred embodiment for practicing the invention in its various applications involves the use of a resilient spherical body composed of an elastomeric material having a cylindrical opening passing through its diameter for receiving multifunctional weights together with multifunctional weights and a multifunctional elastic band of a sufficient width and length to encircle the circumference of the multifunctional exercise ball and close the ends of the opening of the multifunctional exercise ball. The multifunctional elastic band should be of a length sufficient to snugly encircle the circumference of the multifunctional exercise ball when the elastic band is in its unstretched state.

An optional removable cover having loops for maintaining the position of the elastic band is provided in the preferred applications of the invention.

Figure 9:
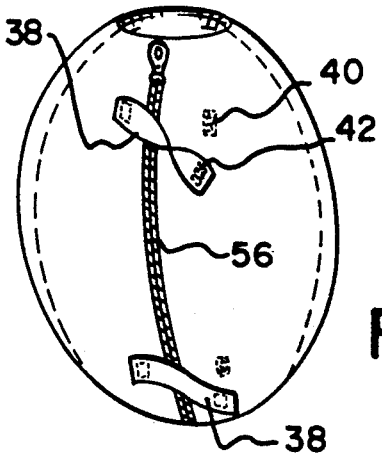
FIG. 9 is a perspective view of the exercise ball cover.
Figure 10:
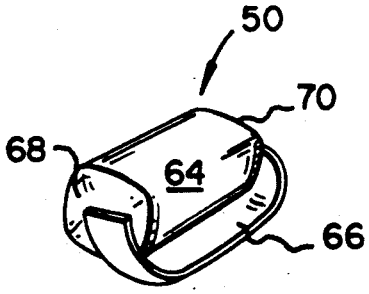
FIG. 10 is a perspective view of one of the multifunctional weights.
Figure 11:
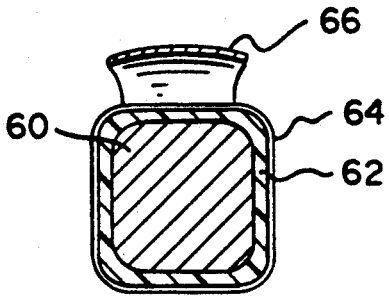
FIG. 11 is a cross sectional view of the multifunctional weight of FIG. 10.
Figure 12:
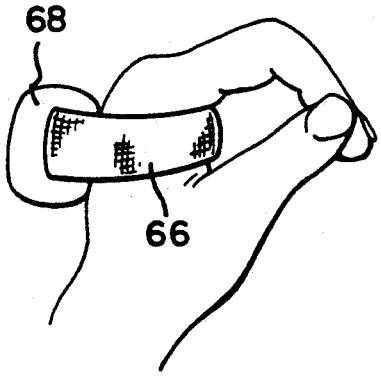
FIG. 12 is a side elevational view illustrating an application of the multifunctional weight.
Figure 13:
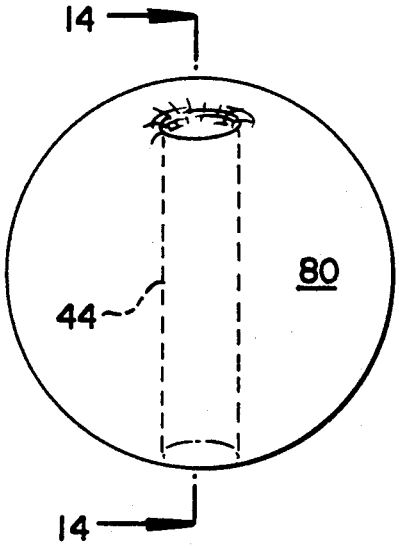
FIG. 13 is a side elevational view partly in phantom illustrating an alternative embodiment for the construction of the elastomeric spherical body of a novel multifunctional exercise ball constructed in accordance with the invention.

Referring now to FIGS. 1, 2, 3, 4, 5 and 6 a novel multifunctional exercise device 30 in the shape of a spherical ball is illustrated having an outer cover 32 which may be made of cloth, canvas or other lightweight elastomeric material such as spandex, lycra or cotton-poly blends of material. The outer cover 32 preferably includes a plurality of belt loops 34 for maintaining a multifunctional elastic band 36 around the circumference of the multifunctional exercise ball cover 32. Belt loops 38 disposed near the top end of the multifunctional exercise ball are designed for detachable attachment to the cover 32 by the utilization of the velcro strip 40 (FIG. 9) with a mating velcro strip 42 on the underside of the loop 38.

The multifunctional exercise ball includes a cylindrical passage 44 extending through the diameter of the multifunctional exercise ball 30. The cylindrical opening or passage 44 extending through the diameter of the multifunctional exercise ball provides two ends 46 and 48, for receiving multifunctional exercise weights 50. The multifunctional exercise ball cover 32 is designed to cover end 48 but leave end 46 open as illustrated in FIGS. 2, 3, 4, and 6. The multifunctional exercise ball cover 32 is designed to include a constricting means 52 for closing one of the open ends to which removable weights 50 can be placed in or removed from passage 44. The constricting means 52 may be an elastic seam or drawstring arrangement but preferably includes a velcro fastener 54 for constricting end 46 once weights 50 have been placed in or removed from passage 44. It is preferable to have the constricting means open and close in the form of a drawstring or velcro fastener so that the constricting means joins the point where the cover meets at and closes at end 46 and includes an opening and closing means such as a zipper 56 to allow the cover to be removed from the resilient spherical body of the exercise ball.

Figure 4:
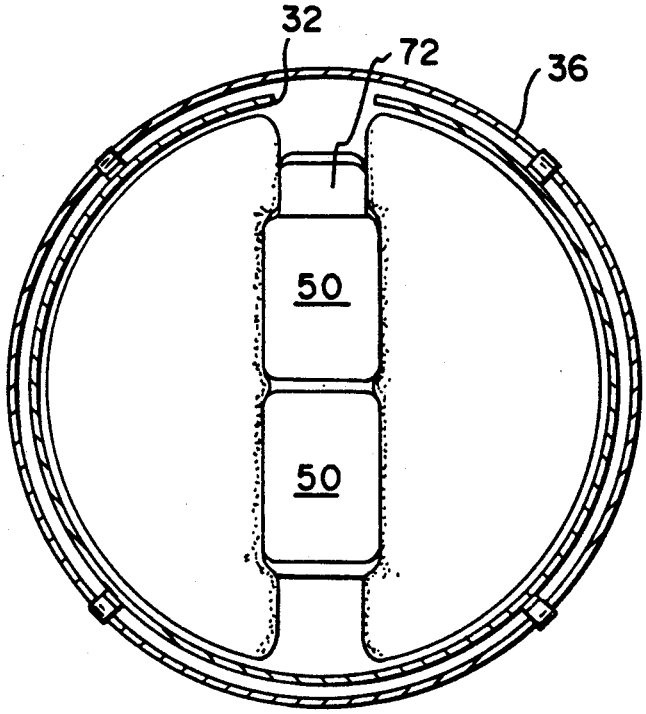
FIG. 4 is a cross sectional view similar to FIG. 2 with both multifunctional weights positioned in the substantially hollow core with an optional weight positioning tube.

The removable weights 50 are designed to stay in position in passage 44 by friction resulting from the larger size of the weight 50 in relation to the size of the passage 44 and the resilient composition of the body of the multifunctional exercise ball. Each of the weights 50 as illustrated in FIGS. 3, 4, 6, 10, 11 and 12 are designed to include a weighted center 60 which may be metal, metal pellets or an encapsulated weight which is surrounded by a padding 62 and covered with a nylon, lycra or spandex cover 64. The weight also preferably includes an elastic or rubber strap 66 connecting ends 68 and 70. Weights 50 may be placed in a weight bag 72 to assist in their insertion and removal as a unit in passage 44 as illustrated in FIG. 4 and FIG. 5. Weight bag 72 similarly may include a handle 74 at one end together with a zipper opening 76 for inserting both weights 50 in weight bag 72 to assist in the placement and nesting of both weights 50 in passage 44 of the multifunctional exercise ball 30. Weight bag 72 may include padding at ends 78 and 80 to assist in the padding of ends 46 and 48 of multifunctional exercise ball 30.

The spherical resilient elastomeric body 80 is composed of a resilient elastomeric material which may be in the form of an open cell foam or a closed cell foam elastomeric material as a means for decreasing the compressibility of the body 80 of the multifunctional exercise ball. In addition as will be described hereinafter in greater detail, body 80 may also be in the form of a bladder which may be filled with air or other liquid to further increase the weight of the multifunction exercise ball and decrease the compressibility of the resilient elastomeric spherical body 80.

The hollow resilient elastomeric body 80 is preferably between 6 and 12 inches in diameter and is preferably about 8 inches in diameter and is designed in light aerobic applications to give about 3 or 4 inches when compressed with between a 5 and 20 pound force exerted on about a four square inch area on the outside surface of the multifunctional exercise ball. Similarly the exercise weights 50 are between 1 pound to 10 pounds and are preferably about 2.5 to 3 inches in length and about 1.5 inch in diameter so that they substantially fill passage 44 when the exercise ball is about 6.5 inches in diameter and the passage 44 is about 1 inch to 1.5 inches in diameter.

As heretofore discussed the body 80 of the multifunctional exercise ball 30 may be uncovered. It is preferable to use a cover 32 (FIGS. 8 and 9) which is designed to close end 48 and only leave end 46 open. Alternatively body 80 may be constructed so that passage 44 does not have two open ends but instead passes through the center of the device and terminates at a point just short of leaving an open second end. The cover 32 is designed to include a zipper 56 for opening and closing cover 32 and removing body 80 from cover 32. Zipper 56 leaves only end 46 open and is designed to constrict around end 46 as heretofore described.

Figure 14:
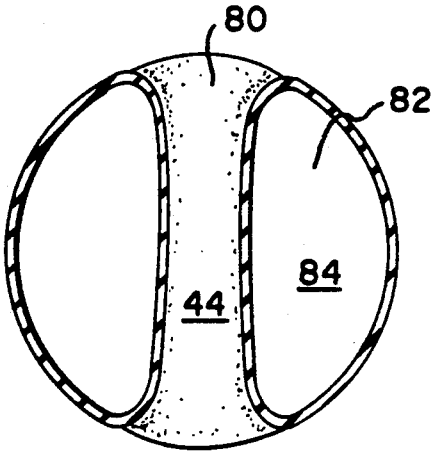
FIG. 14 is a cross sectional view of FIG. 13 taken along the line 14—14.
Figure 15:
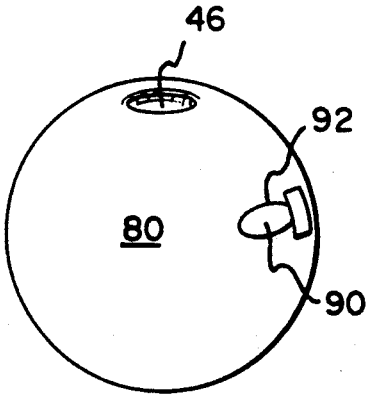
FIG. 15 is a further embodiment of the body of the exercise ball of FIG. 13 and 14 including an inflating device.
Figure 16:
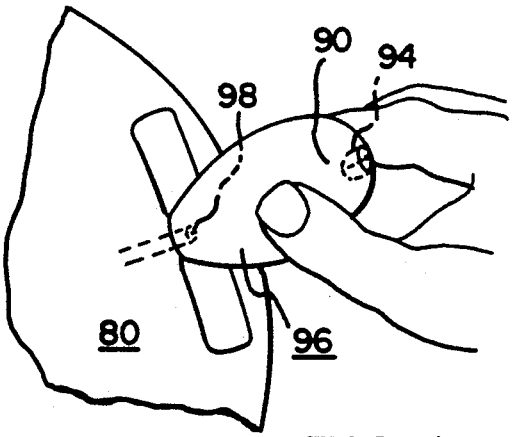
FIG. 16 is a perspective view of a portion of FIG. 15.

Referring now to FIGS. 13, 14, 15, 16, 17, 18, 19, 20 and 21, various alternative embodiments of the multifunctional exercise ball 30 are illustrated. More particularly the exercise ball as illustrated in FIG. 14 includes a hollow body 80 in the form of a bladder having one or more air chambers 84 which may be filled with air such as nitrogen or oxygen or other fluids such as water or other liquid to increase the weight of the exercise ball and decrease the compressibility of the multifunctional exercise ball.

Figure 17:
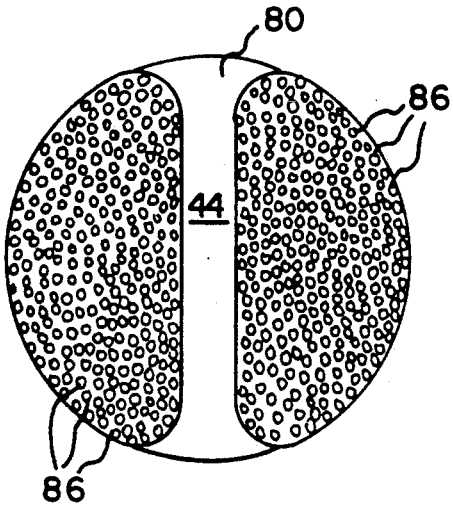
FIG. 17 is further embodiment of the body of the novel multifunctional exercise ball utilizing a closed cell resilient material.
Figure 18:
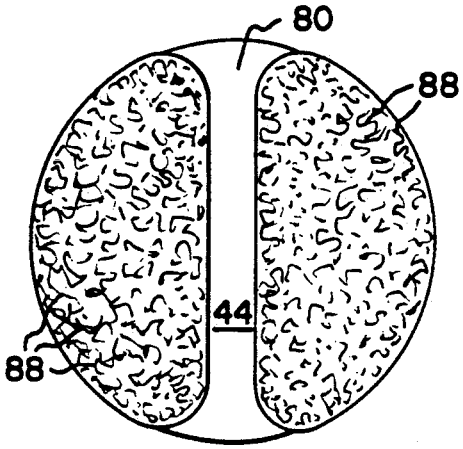
FIG. 18 is a further embodiment of the body of the novel multifunctional exercise ball utilizing a fibrous packing material.

In applications where a bladder is employed the body 80 may utilize a gas encapsulation inside the ball or may be a closed cell plastic material such as illustrated in FIG. 17. The closed cell plastic material containing numerous air pockets 86 are designed to maintain a more even air pressure and provide an increased resistance to compressibility for purposes of increasing the pressure required to provide a more active aerobic workout. Alternatively the inside 82 of body 80 may be filled with fibrous packed material 88 as illustrated in FIG. 18. In all these embodiments open passage 44 remains available in the center of body 80 for receiving one or more weights which may be added to further increase the weight of the exercise ball and to further decrease the amount of compressibility of the novel multifunctional exercise ball.

Referring now to FIGS. 13, 14, 15 and 16, the bladder body 80 of the multifunctional exercise ball 30 may be further modified to include a pump means 90 for adding fluid pressure to the interior 84 of body 80. The air or fluid addition mechanism 90 is designed to nestle into an opening 92 in the body 80 of the multifunctional exercise ball. The fluid addition means includes a first valve 94 for admitting air into the rubber pump body 96 which cooperates with a second valve 98 for admitting air into the interior 82 of body 80 in a manner well known to those skilled in the art of pump valves and pump design.

Figure 1:
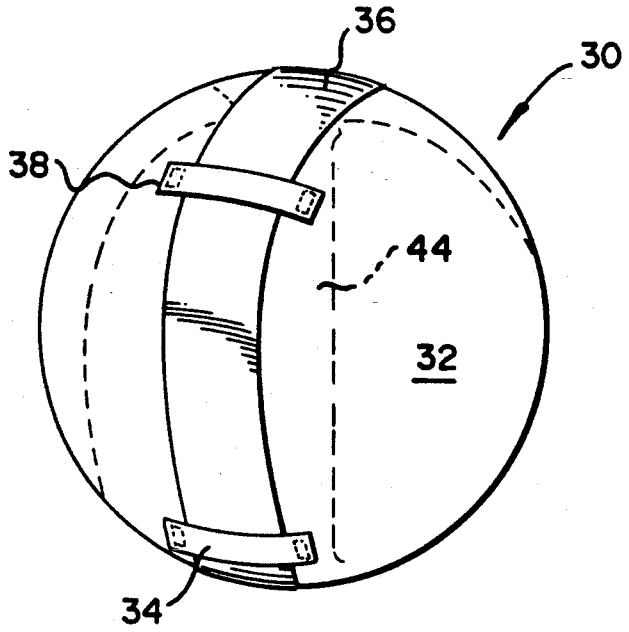
FIG. 1 is a perspective view partly in phantom illustrating a novel multifunctional exercise ball constructed in accordance with the invention.
Figure 2:
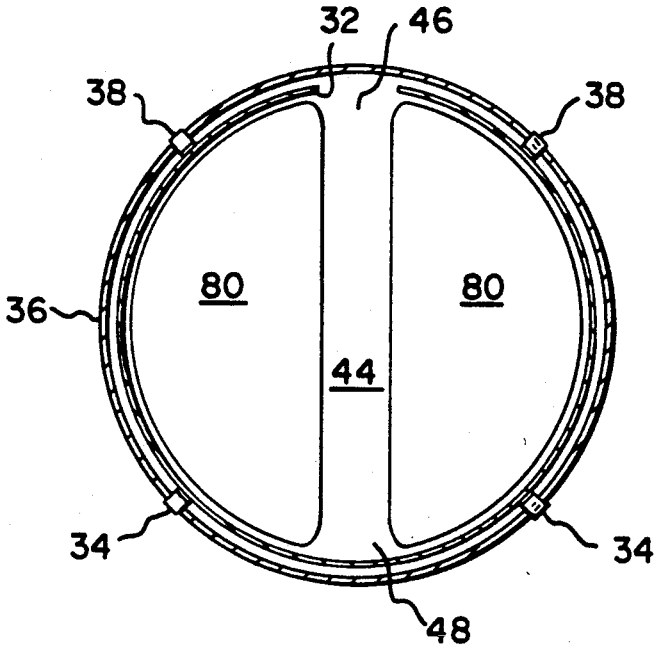
FIG. 2 is a cross sectional view of FIG. 1 with the multifunctional weight removed from the hollow core.
Figure 3:
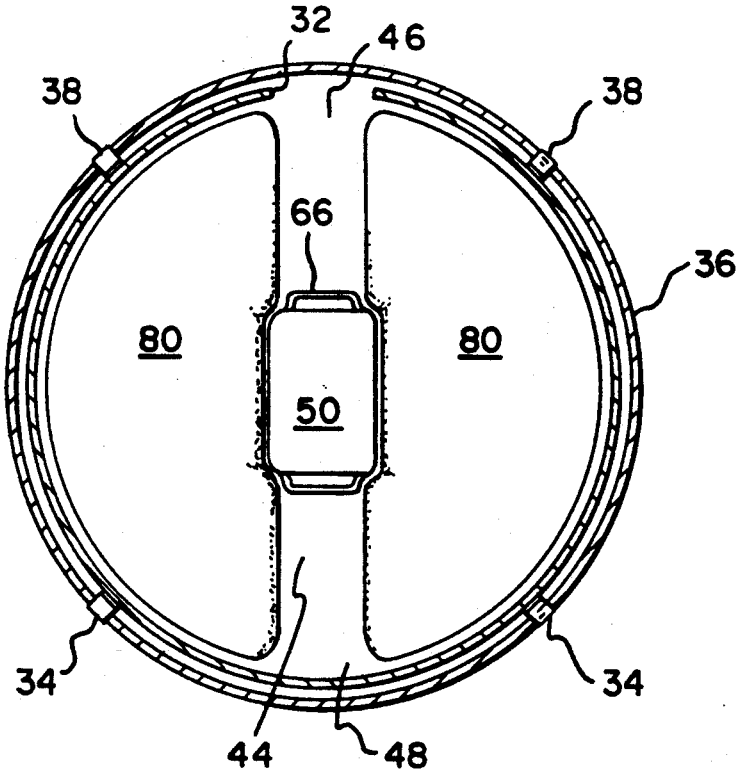
FIG. 3 is a cross sectional view similar to FIG. 2 with a single multifunctional weight disposed in the hollow core.
Figure 20:
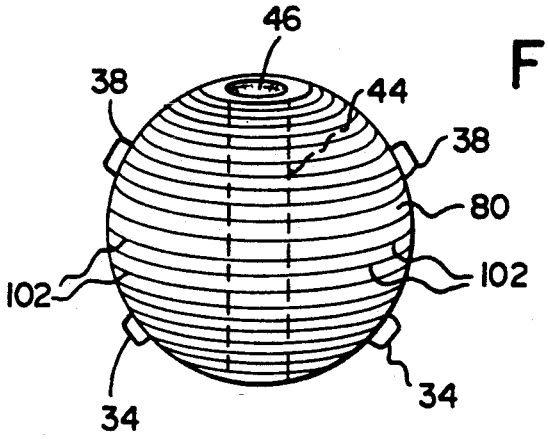
FIG. 19, 20 and 21 illustrate various types of bodies and covering materials for the novel multifunctional exercise ball.
Figure 19:
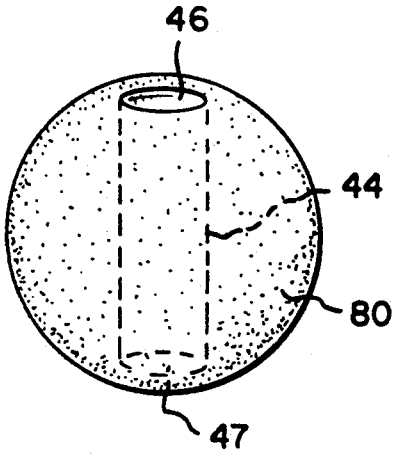
Figure 21:
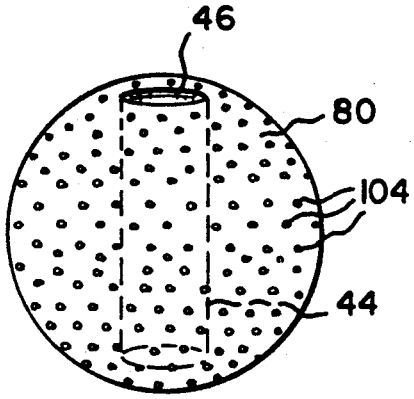

Referring now to FIGS. 19, 20 and 21 various forms of the body 80 are illustrated. In the case of FIG. 19, body 80 is constructed of a high density foam having only one opening 46 which extends substantially but not completely through to an open end 48. Passage 44 terminates just prior to end 47 which body 80 may or may not be covered with a cover 32. In FIG. 20 and 21 various forms of ribbing or grooves 102 or hand restraining dots 104 are provided on the surface of the ball. The balls of FIG. 20 and 21 similarly do not include a passage 44 that extends completely through to an open end 48. The body of balls 80 in FIGS. 20 and 21 are designed to not include an outer cover but are designed to be surrounded with an elastic or rubber multifunctional strap 36 to cover open end 46 (FIG. 1). The elastic or rubber multifunctional strap may be secured in place with or without optional positioning loops 34 and 38 disposed on the surface of body 80. Passage 44 is designed to accept the removable multifunctional weights or a plug component in an optional weight bag 72. In other embodiments the weight bag 72 can be in the form of a plug filled with gas, smaller plastic air filled cells or weights for decreasing the compressibility of body 80 of the multifunctional exercise ball.

The cylindrical passage 44 allows various types of weights and plugs to be inserted to increase the versatility of the multifunctional exercise ball. The multifunctional weights can be utilized either separately in arm and leg exercises utilizing the plastic straps 66 to attach the weights to various parts of the body or can be placed in the ball to provide more resistance to the compressibility of the multifunctional exercise ball.

Figure 22:
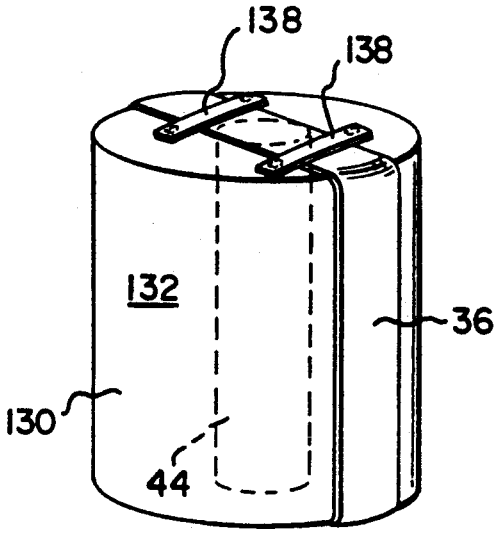
FIG. 22 is a perspective view partly in section of the novel multifunctional exercise device illustrating the device in a cylindrical embodiment.
Figure 23:
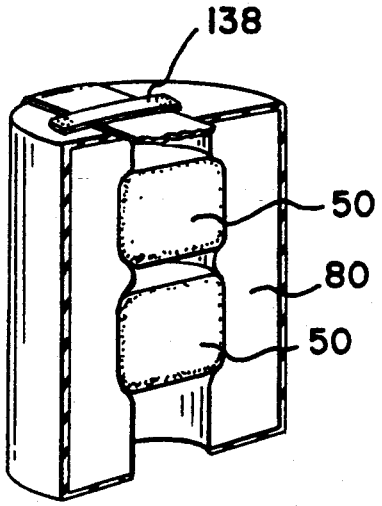
FIG. 23 is a cross sectional view of FIG. 22.
Figure 24:
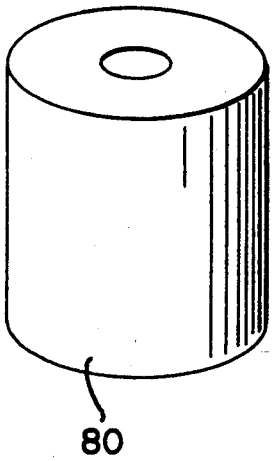
FIG. 24 is a perspective view of the resilient body of the multifunctional exercise device.
Figure 25:
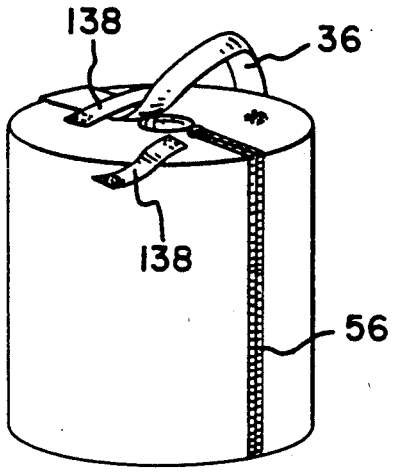
FIG. 25 is a perspective view similar to FIG. 22 illustrating the cover and detachable loop.

The multifunctional exercise device of the invention does not of necessity have to have a spherical configuration. As illustrated in FIGS. 22–25 the multifunctional exercise device may be of a cylindrical configuration. The cylindrical exercise device 130 as illustrated in FIG. 22 can employ a cover 132 having loops 138 for detachably securing an elastic band 36 in place. Band 36 may be of natural or synthetic rubber or other material such as an elastic fabric. The cylindrical multifunctional exercise device similarly includes a passage 44 for detachably receiving multifunctional weights 50.

The resilient body 80 of multifunctional exercise device 130 may similarly be constructed of foam or of a bladder construction as was previously described with regard to the spherical embodiment of the invention. The resilient body 80 of the cylindrical configuration may similarly be covered with a cover 132 which includes a zipper 56 as was previously described with regard to the spherical embodiments of the invention.

Referring now to FIGS. 26–34, various forms of low impact toning exercises can be used for toning muscles and isolating the various types of muscles during floor work routines. The squeezing and pushing of the multifunctional exercise device in a repetitive fashion along with the pulling and stretching of the multifunctional strap 36 provides numerous types of work out routines. As previously discussed the elasticity of strap 36 can be modified in a wide range of elasticity configurations by utilizing different types and thicknesses of elastic materials such as woven elastic fabric or natural or synthetic rubbers to increase or decrease the amount of force required to stretch the strap depending upon the strength of the user and specific design and application of the multifunctional exercise ball.

Figure 26:
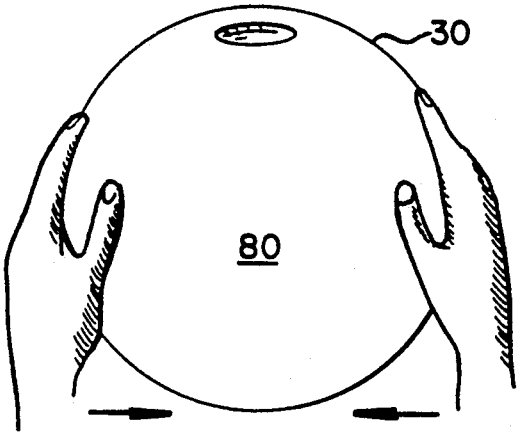
FIG. 26 and 27 illustrate various hand and arm exercises for the novel multifunctional exercise ball.
Figure 27:
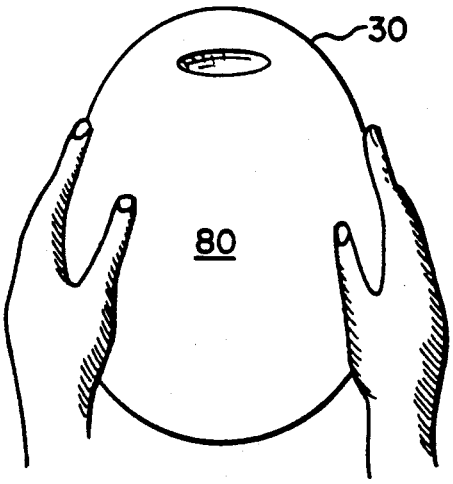
Figure 28:
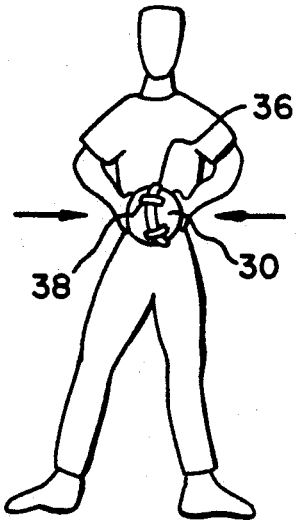
FIG. 28–34 illustrate various types of body exercises utilizing the novel multifunctional exercise device.
Figure 29:
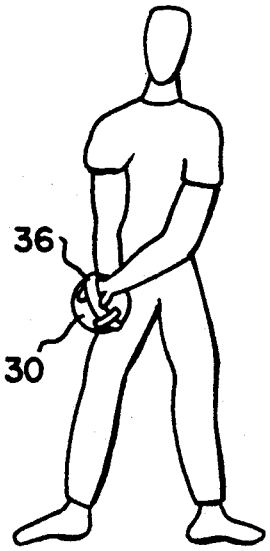
Figure 30:
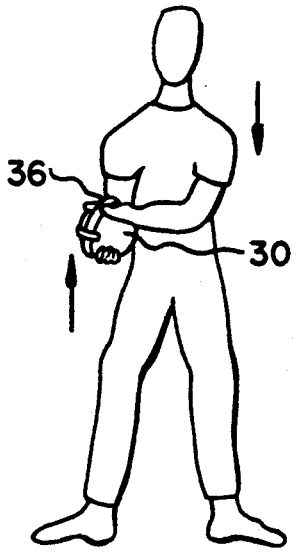

The squeezing and pushing of the body 80 of the multifunctional exercise ball 30 as illustrated in FIG. 26 and 27 with or without the multifunctional weights serves to strengthen arms, chest and other upper body parts utilizing a low impact aerobic workout. The squeezing of the ball as illustrated in FIG. 28 provides isometric contraction of muscle groups where both hands push equally into the resistant compressive core of the multifunctional exercise ball. Arms can be held overhead (not shown) or in front of the body or close to or away from the chest and the movements can be pulsed slow or fast. In addition, various types of arm exercises for isokinetic or isotonic contractions can be achieved by utilizing right arm curls by flexing at the elbow against the resistance of gravity and the weights if the weights are inserted in the ball or against the resistance of the left arm as it pushes down into the resistant compressive core or lifts up against the multifunctional strap 36 as illustrated in FIG. 30.

Figure 31:
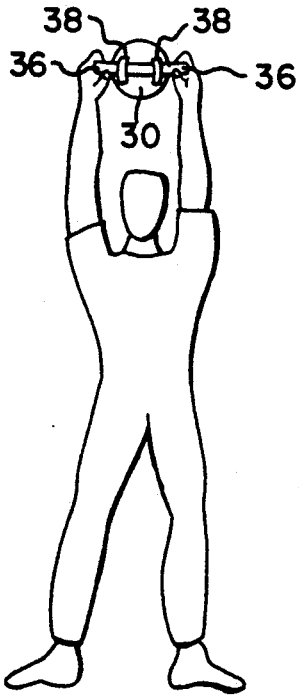
Figure 32:
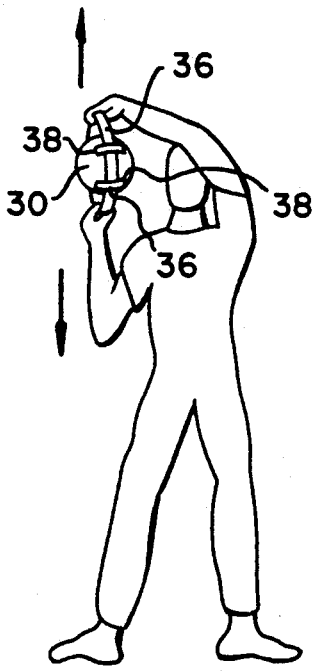
Figure 33:
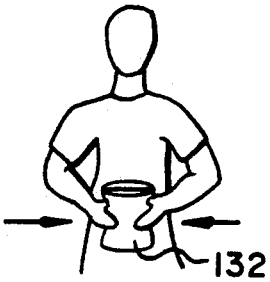
Figure 34:
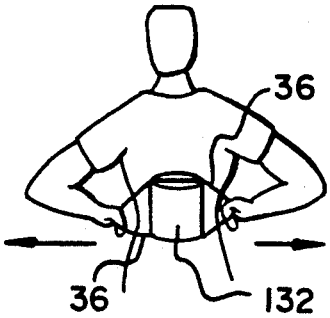

Referring now to FIG. 31 and 32, latissimus pull downs can be achieved utilizing isokinetic or isotonic contractions. In such cases the right arm pulls down (adducts) against the resistance of the multifunctional band 36 and against the resistance of the left arm as it pulls up to work muscles in the back. These same exercises can be performed as well as other exercises using the cylindrical shaped embodiment 132 or other geometrical shapes as contemplated by the invention.

The various exercises illustrated in FIGS. 26–34 plus others can be employed to exercise and isolate the exercise of various muscle groups. Using the multifunctional exercise device, every major muscle group can be exercised as illustrated in Table 1.

TABLE 1

| | |
|---|---|
| CHEST | HIP |
| single arm chest presses | hip abduction |
| single arm chest flys | hip flxors |
| chest squeezes | adductors |
| BACK | ABDOMINALS |
| latissimus pulldowns | sit ups |
| rows | reverse sit ups |
| | cross overs |
| SHOULDERS | ARM |
| overhead press | bicep curls |
| arm raises | tricep presses |
| lateral arm raises | finger flexes |
| upright row | |

As will be recognized by those skilled in the art present invention has a wide range of applicability and can be modified in many different ways to provide useful exercises for a wide variety of people. The invention is thus applicable in various embodiments to all ages and strengths of people who desire to increase body strength, muscle tone and endurance utilizing low impact workouts. The invention can be configured so that a minimum of strength is required to exercise or the invention can be adapted to provide much more vigorous physical workout by increasing the size of the weights and decreasing the compressibility of the body of the exercise device by utilizing a bladder which can be filled with fluids. It is also possible to modify the invention to include a layer of foam which covers a bladder having means for increasing or decreasing the compressibility of the bladder. Many such variations in the body of the ball are possible which in combination with the novel multifunctional strap which may be constructed of various materials including heavy duty rubber which requires considerable strength in the range of 40 to 100 pounds or greater to pull the multifunctional strap away from the body of the multifunctional exercise device.

As a result the invention may be implemented in a variety of ways utilizing various substitutions and modifications for the resilient core material of the multifunctional exercise device by increasing or decreasing the compressibility of the resilient body alone or in combination with multifunctional weights together with a multifunctional band for encircling the body of the multifunctional exercise device. In all such embodiments the compressible resilient body is surrounded by the multifunctional strap which is about equal to or slightly less than the outside perimeter of the multifunctional exercise device so that pulling of the strap against the body of the exercise device variably increases the resistance as the strap is pulled either away from the exercise device or away from one of the sides of the exercise device to provide a multitude of variable exercises utilizing hands, legs and other parts of the body.

The invention may be further implemented and modified in a variety of ways to suit particular applications depending upon the age level and level of strength for exercise workouts and routines. Consequently it is intended that these and other modifications and applications of the invention can be made within the spirit and scope of the invention as defined in the following claims.

What is claimed is:

1. A multifunctional exercise device comprising:

(a) an elastomeric body having a substantially cylindrical opening extending from a first surface of said elastomeric body through the diameter to a point at or near the opposite side of said first surface of said elastomeric body;

(b) a removable elongated multifunctional weight encased in a layer of passing having a perimeter slightly larger than the circumference of said substantially cylindrical opening, said layer of padding cooperating with said substantially cylindrical opening to detachably engage and maintain said elongated multifunctional weight in less than the entire length of said substantially cylindrical opening;

(c) a multifunctional elastomeric band surrounding the outside circumference of said elastomeric body and extending from said substantially cylindrical opening in said first surface to said point at or near the opposite side of said elastomeric body, said multifunctional band providing a cover for said substantially cylindrical opening; and (d) at least one loop disposed intermediate said opening in said first surface and said point at or near the opposite side of said elastomeric body to maintain said elastomeric band substantially in place around said elastomeric body.

2. The multifunctional exercise device of claim 1 further comprising a removable cover.

3. The multifunctional exercise device of claim 2 wherein said removable cover includes said at least one loop for maintaining said multifunctional elastomeric band substantially in place.

4. The multifunctional exercise device of claim 3 wherein one of said least one loop has a detachable end.

5. The multifunctional exercise device of claim 1 wherein said elastomeric body is substantially spherical and includes at least two loops for maintaining said multifunctional elastomeric band in place.

6. The multifunctional exercise device of claim 5 further comprising a pump means for increasing fluid pressure inside said substantially spherical elastomeric body.

7. A multipurpose exercise device comprising:

(a) an elastomeric body of a compressible material having a substantially cylindrical passage extending from a first surface to a second surface and passing substantially through the center of said elastomeric body, said first surface being disposed substantially opposite to said second surface;

(b) an elongated multifunctional weight covered with a layer of padding and having an elastomeric strap and a perimeter slightly larger than the circumference of said substantially cylindrical passage;

(c) a cover for covering said elastomeric body;

(d) a multifunctional elastomeric band disposed on the outside surface of said cover for covering said elastomeric body and covering said first surface and said second surface; and (e) at least one loop disposed on said cover for maintaining the position of said multifunctional band on said outside surface of said cover for covering said elastomeric body.

8. The multipurpose exercise device of claim 7 wherein said elastomeric body is constructed of a foam.

9. The multipurpose exercise device of claim 8 wherein said foam is a closed cell foam.

10. The multipurpose exercise device of claim 7 wherein said elastomeric body is a bladder.

11. The multipurpose exercise device of claim 10 wherein said bladder includes means for adjusting the fluid pressure inside said bladder.

12. The multipurpose exercise device of claim 11 wherein said means for adjusting the fluid pressure is a pump.

13. The multipurpose exercise device of claim 7 wherein said cover includes a constrictive closure for closing said first surface.

14. The multipurpose exercise device of claim 7 further comprising a second multifunctional weight having an elastomeric strap.

15. The multifunctional exercise ball comprising:

(a) a substantially spherical elastomeric body having a substantially cylindrical passage extending from a first opening to a second opening and through the center of said substantially spherical body;

(b) a multifunctional weight element having a perimeter slightly larger than the circumference of said substantially cylindrical passage which cooperates with said substantially cylindrical passage to engage and maintain said multifunctional weight element in less than the entire length of said substantially cylindrical passage by constricting said perimeter of said multifunctional weight element in said substantially cylindrical passage;

(c) a cover for covering said substantially spherical elastomeric body and covering said second opening; and (d) a multifunctional elastomeric band for surrounding the circumference of said substantially spherical elastomeric body and covering said first opening.

16. The multifunctional exercise ball of claim 15 wherein said cover includes a constrictive closure means for closing said first opening.

17. The multifunctional exercise ball of claim 16 wherein said cover includes a zipper extending from said constrictive closure means to said second opening.

18. The multifunctional exercise ball of claim 16 wherein said substantially spherical elastomeric body is composed of a foam material.

19. The multifunctional exercise ball of claim 18 wherein said foam material is a closed cell foam material.

20. The multipurpose device of claim 7 wherein said elastomeric body is substantially elliptical and wherein said at least one loop includes a detachable end.

* * * * *